United States Patent [19]

Gauthier

[11] 4,316,587

[45] Feb. 23, 1982

[54] DEVICE FOR REGULATING THE TENSION OF A TRAVELLING WEB

[75] Inventor: Jean Gauthier, Le Mur Barre, France

[73] Assignee: Astin-France Assistance Technique Industrille, France

[21] Appl. No.: 156,022

[22] Filed: Jun. 3, 1980

[30] Foreign Application Priority Data

Jun. 8, 1979 [FR] France ..... 79 15211

[51] Int. Cl.[3] ..... B65H 59/00; B65H 25/22

[52] U.S. Cl. ..... 242/75.53; 242/75.43

[58] Field of Search ..... 242/75.53, 75.4, 75, 242/75.43

[56] References Cited

U.S. PATENT DOCUMENTS

| | | | |
|---|---|---|---|
| 2,343,181 | 2/1944 | Heinz | 242/75.53 X |
| 2,988,297 | 6/1961 | Pawlowski | 242/75.53 |
| 3,164,333 | 1/1965 | Robertson | 242/75.43 |
| 4,000,865 | 1/1977 | Gaskins | 242/75.53 |

*Primary Examiner*—Edward J. McCarthy

*Attorney, Agent, or Firm*—Robert E. Burns; Emmanuel J. Lobato; Bruce L. Adams

[57] ABSTRACT

A device for regulating the tension of a travelling web moved as a result of the application of traction includes a roller freely rotatable about its axis arranged transversely with respect to the direction of web travel. This roller is in contact with one side of the web and deflects the latter upstream of the traction means. A spindle of the roller is supported at each end by a support which allows a movement of the end in a direction substantially perpendicular to the web, by applying to the end, in this direction and towards the web, a predetermined force which is identical from one support to the other and is constant, whatever the position of the end. The device applies tension over the length and width of the web such as a paper web as is used in the corrugated cardboard industry.

6 Claims, 2 Drawing Figures

DEVICE FOR REGULATING THE TENSION OF A TRAVELLING WEB

FIELD OF THE INVENTION

The present invention relates to a device for regulating the tension of a travelling web.

BACKGROUND OF THE INVENTION

In numerous technologies webs of flexible material such as paper or plastics material are used as raw materials and are caused to travel at high speed, for example while unwinding them from a reel. It is important to maintain a constant tension of the web during its travel and to distribute this tension as uniformly as possible over the width of the web whatever the anomalies which may occur, such as for example an elongation of one side with respect to the other or waving of the edges.

This is the case, for example, in the manufacture of corrugated cardboard, where unequal tension over the length and/or width of one of the sheets of paper used in manufacture may result in faults in the corrugated cardboard produced.

Generally, one acts on the tension of the web, travelling under the action of pulling means generally constituted by a machine ensuring the transformation of this web, such as for example a machine for connecting this web to other webs, by modulating a braking action applied to this web upstream of the drive means taking into account its direction of travel. To this end a roller is provided in the path of the web, in contact with one side of the latter, which roller is mounted to rotate freely about a transverse axis with respect to the direction of travel and which is able to move over a short distance in a direction perpendicular to the web, depending on the pressure which the latter applies thereto. The movement of the axis of the roller controls a brake acting downstream of the direction of travel of the web, as for example when it is being unwound from a reel, to establish regulation of the tension of the web resulting in a tendency of the roller to remain in a predetermined mean position, depending on the predetermined longitudinal tension to be maintained in the web. To ensure that this tension is distributed as uniformly as possible over the width of the web, a second roller is also provided in the path of the latter, downstream of the roller controlling the braking, which second roller is also in contact with one of the sides of the web and is able to rotate freely about its axis which is arranged perpendicular to the direction of travel. One of the ends of this roller is pivoted at one side of the travelling web on a fixed support and its other end, located on the other side of the web, is able to move at right angles to the latter depending on any possible transverse deformation of the web resulting in different longitudinal tensions over its width, in order to tend to distribute uniformly over the width of the web, the longitudinal tension regulated by the play of the first roller.

One drawback of this system resides in the necessity of making the web follow a complicated circuit since, in order to be effective, the two successive rollers must deflect the latter. This drawback is particularly noticeable if one takes into account the high speeds, of the order of several hundreds of meters per minute, at which modern machines process travelling webs.

Furthermore, installations for carrying out the system are expensive, since it is necessary to provide not only the two above-mentioned rollers, but also the associated regulating means.

Finally, the efficiency of such an installation is very limited.

In fact, the traction exerted by the web on the first roller may cause a complete vertical movement of the latter without this resulting in a complete correction of the increase in tension of the web which is the cause of this, and consequently it may happen that, at certain points of the web, tensions occur which may cause rupture of the latter. As regards the movement of the second roller, this is generally left to the judgement of an operator, depending on any transverse deformation of the web which he observes, which renders an instantaneous correction of the fault impossible, the high speed of travel of the web being incompatible with a correction of this fault by a manual action upon the fault being sighted.

SUMMARY OF THE INVENTION

The object of the present invention is to obviate or mitigate these drawbacks by an automatic and continuous action, thus relieving the operator of a frequently ineffective attempt at correcting faults while greatly improving the quality of the finished product and, to this end, the invention proposes to replace the two aforesaid rollers by a single floating roller making it possible, during the travel of a web and, for example, during the unwinding of a reel of paper or of any other material, to correct automatically the anomalies which sometimes occur in the actual body of the web, such as an extension of one side with respect to the other or waving of these edges, and to transmit to a brake regulating member the actual tension exerted by the web on the roller in order to maintain, by acting on the brake, a constant tension on the web whatever the diameter of the reel from which it is unwound and whatever the unwinding speed.

The possibility of combining the action of straightening the web with the collection of information relating to the actual weight exerted by the latter on the roller in order to modulate its braking upstream, provided by the device according to the invention, makes it possible to retain constant tension over the length of the web, which is distributed as uniformly as possible over its width, in order to contribute to an improvement in the quality of the finished product.

The device, according to the invention, for regulating the tension of a web travelling under the action of traction comprises a roller free to rotate about its axis arranged transversely with respect to the direction of travel of the web, the roller being in contact with one side of the web and deflecting the latter upstream of the means applying traction, and the device being characterised in that a spindle of the roller is supported in the region of each of its two ends by two supports allowing a movement of each end in a direction substantially perpendicular to the web while applying to said end, in this direction and towards the web, a predetermined force which is identical from one support to another and is constant whatever the position of said end during its movement.

Advantageously, means are provided for imparting a braking action to the web upstream of the roller and the device, according to the invention, is also characterised in that means are provided for controlling the braking action depending on the position of the ends of the roller.

BRIEF DESCRIPTION OF DRAWINGS

An embodiment of the present invention will now be described, by way of example, with reference to the accompanying drawings, in which.

DESCRIPTION OF PREFERRED EMBODIMENT

Figure 1:
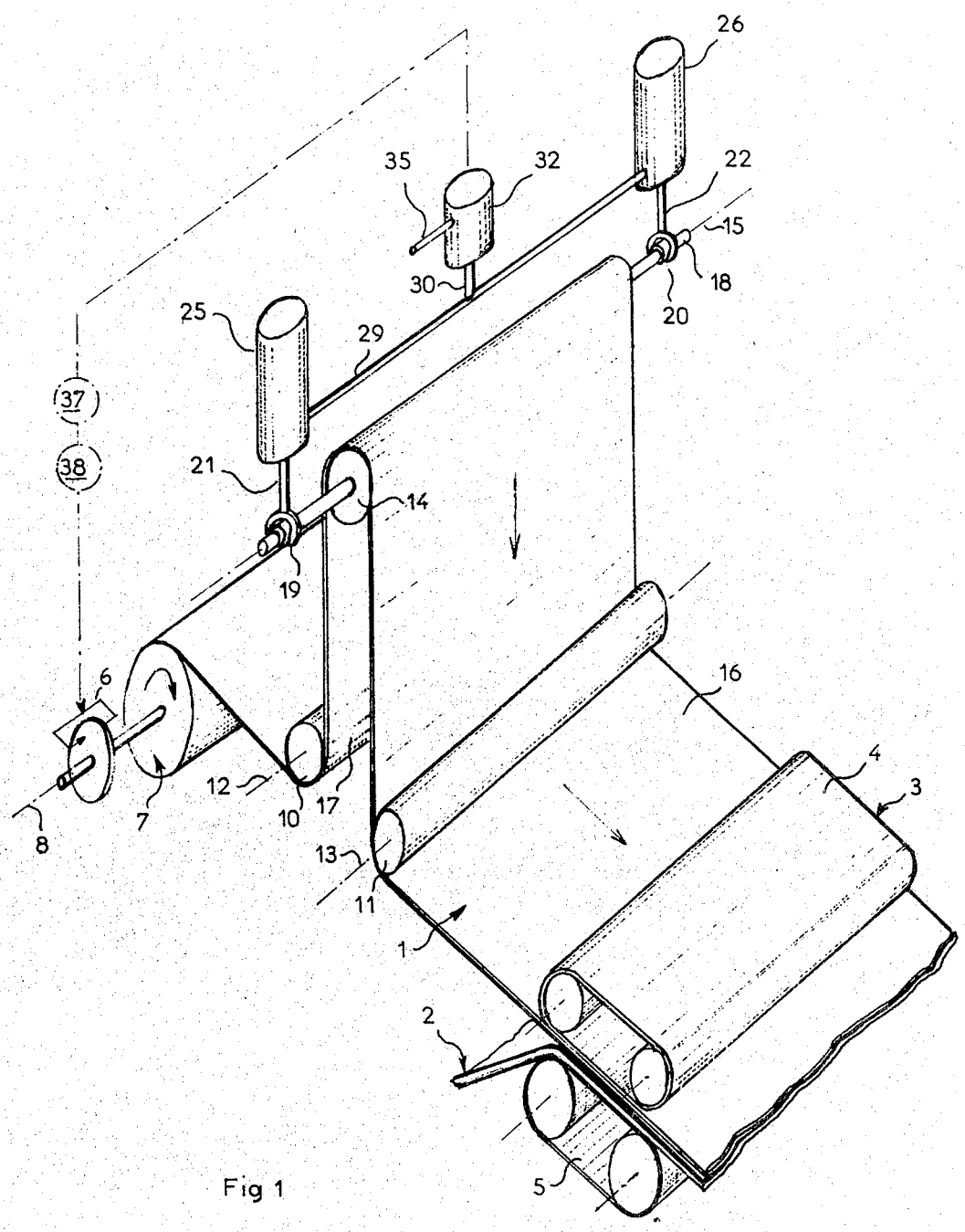
FIG. 1 is a perspective view of the device according to the invention.

The reference numeral 1 designates a web of flexible material such as paper or a sheet of plastics material, intended for example to be stuck face to face with a second similar web 2 in a machine shown diagrammatically at 3, where they are placed in mutual contact under pressure and made to travel in their longitudinal and common direction, under conditions which promote their interconnection, for example under the action of two horizontal endless conveyors 4 and 5 which are set in movement for this purpose by means which are not shown.

The travel of the web 1 parallel to its longitudinal direction, owing to the traction applied by the machine, has been illustrated diagrammatically in FIG. 1 by arrows.

In the example illustrated, the web 1 is unwound from a reel 7 which is mounted to rotate freely about its horizontal axis 8, owing to the traction which is applied thereto by the machine 3. In manner known per se, a brake 6 is provided acting on the roller 7 in order to tend to oppose the rotation of the latter in the unwinding direction 9, in an adjustable manner and at will. This adjustable resistance to unwinding makes it possible to subject the web 1, over its entire length between the roller 7 and the machine 3, to a longitudinal tension of adjustable value.

On its path between the roller 7 and the machine 3, the web 1 is deflected by an arrangement of three rollers mounted to rotate freely about their axes, namely two lower rollers 10 and 11, whereof the respective axes 12 and 13 are fixed, parallel to each other and parallel to the axis 8 and an upper roller 14, whereof the axis 15 is able to move in a vertical plane parallel to the axes 12 and 13 and located between the latter. Means which will be described facilitate a movement of the axis 15 in this plane, where it nevertheless always occupies positions parallel to, or approximately parallel to, those of the axes 12 and 13. The cylindrical periphery of the rollers 10 and 11 is in contact with the upper side 16 of the web 1, whereas the intermediate roller 14 is in contact with the lower side 17 of the latter, between the rollers 10 and 11, so that the weight of the web 1 and the tension of the latter results in a downwards pulling movement applied to the roller 14, the web being supported towards the top, on either side of the latter, against the rollers 10 and 11.

By each of the ends of a coaxial shaft 18, located respectively on each side of the path of the web, the roller 14 is mounted to rotate freely about its axis 15 in bearings 19 and 20 respectively, each of which is suspended from the lower end of a vertical rod 21 and 22 respectively, the upper end of which is integral with the piston 23 and 24 respectively of a single-acting vertical jack 25 and 26 respectively whereof the body is fixed in particular with respect to the axes 12 and 13.

In order to allow the roller 14 to assume positions in which its axis 15 is parallel to the axes 12 and 13 as well as positions in which it is not parallel to the latter, the bearings 19 and 20 are pivoted to the respective lower ends of the rods 21 and 22.

Figure 2:
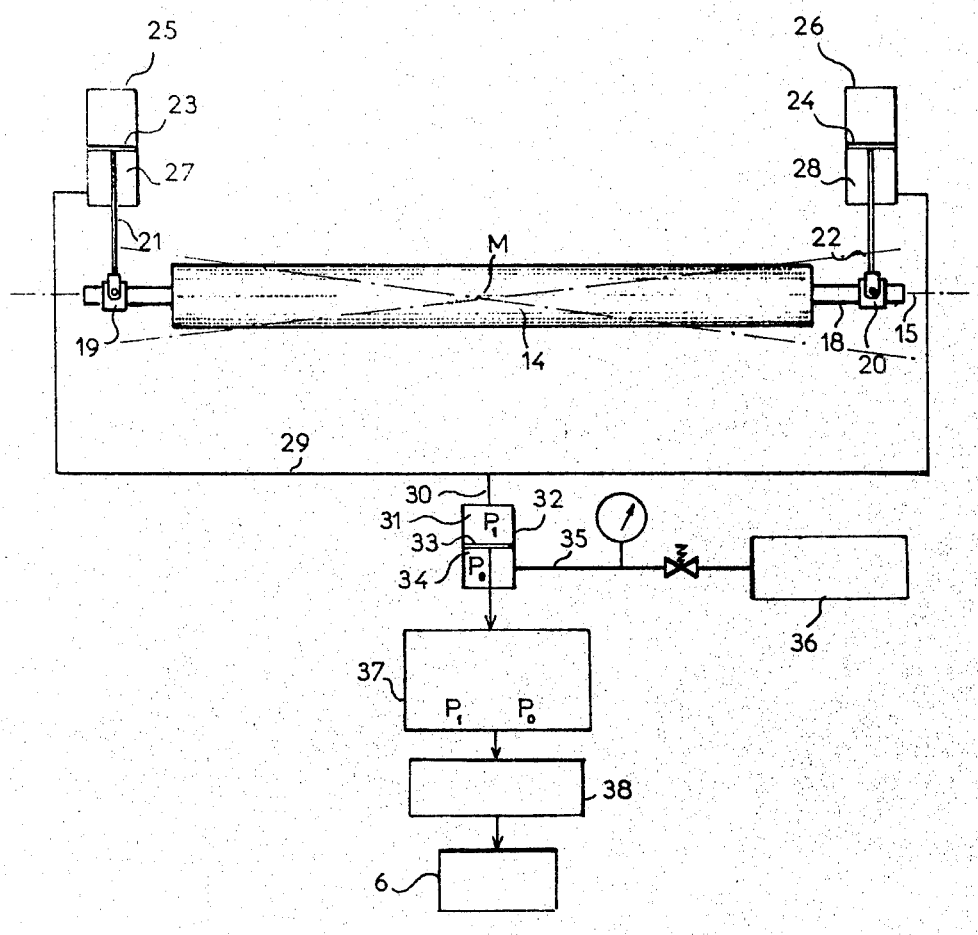
FIG. 2 illustrates diagrammatically the operation of the device.

With particular reference to FIG. 2, it will be seen that inside the jacks 25 and 26, the pistons 23 and 24 drawn downwards by the weight of the roller 14 and by the weight of the section of the web 1 located between the rollers 10 and 11 and the tension of the web tend to compress a fluid housed in a chamber 27 and 28 respectively, located between the piston and the lower end of the jack body. This fluid is chosen to be non-compressible and in practice is of a hydraulic nature.

The two chambers 27 and 28 are connected by a pipe 29 of small diameter, which is also filled with this fluid, which makes it possible to maintain the same pressure in the chambers 27 and 28 whatever the position of the pistons in the jacks, i.e. whatever the orientation and the level of the axis 15 with respect to the axes 12 and 13.

In order to establish this pressure at a predetermined value, in reaction to the repercussion on the pistons 23 and 24 of the weight of the roller 14 and of that of the section of web located between the rollers 10 and 11, an action which is virtually constant over a period of time and the repercussion of the tension of the web, the pipe 29 comprises a branch 30 leading to the chamber 31 of a jack 32, the movable piston 33 of which establishes a sealed separation between this chamber 31 and a second chamber 34 connected by a pipe 35 to a source 36 of a fluid under pressure, such as air, making it possible to establish therein an adjustable predetermined pressure $P_o$, which is generally constant over a period of time for the same treatment applied in the vicinity of the machine 3. The pressure $P_1$ of the fluid in the pipes 30 and 29 and in the chambers 27 and 28 tends to come into equilibrium with this pressure $P_o$, which results in the application to the two ends of the shaft 18 of the roller 14 of vertical ascending traction of constant intensity and of pre-determined value which can be adjusted by adjusting the value $P_o$.

This traction is applied whether or not the axis 15 is parallel to the plane of the axes 11 and 12 and whatever its level with respect to this plane, which in other words means that whether or not the web 1 has absolutely parallel edges and qualities of resistance to traction which are absolutely identical from one edge to the other, which respectively results in a position of the axis 15 absolutely parallel to that of the axes 12 and 13 or on the contrary in a position of the axis 15 which is oblique with respect to these axes, the jacks 25 and 26 apply a pre-determined force which can be adjusted by adjusting the pressure $P_o$ and is constant if this pressure is constant, to the web, through the intermediary of the drum 14.

For a pre-determined pressure $P_o$ of the fluid in the chamber 34 and if the web imposes on the roller 14 a constant force in the downwards direction, i.e. if its tension is constant, the axis 15 of the roller may pivot about the point M located halfway along the length of the latter, as illustrated diagrammatically in FIG. 2, but the level of the point M is constant. The roller 14 thus distributes the tension uniformly over the entire width of the web, even if the latter is slightly deformed.

If, on the other hand, the tension of the web should vary for a constant pressure $P_o$, the mean level of the axis 15 with respect to the axes 12 and 13, i.e. the level of the centre point M of the roller 14, tends to vary since an increase in the tension tends to cause the roller 14 to drop with compression of the fluid in the chambers 27 and 28, whereof the pressure $P_1$ tends to become greater than $P_o$ and a reduction of the tension of the web 1 on the contrary results in raising of the roller 14 which results in a tendency of the pressure $P_1$ to become less than $P_o$.

This results in a movement of the piston 33 of the jack 32 in the direction of lower pressures, i.e. from the chamber 31 towards the chamber 34 in the first case and conversely in the second case and in a preferred embodiment of the invention it is provided to control the brake 6 according to this movement, in order that it acts in order to re-establish the tension of the web 1 automatically at the pre-determined value corresponding to equality of the pressures $P_1$ and $P_o$, i.e. also to the occupation of a pre-determined mean position by the piston 33 in the jack 32 and by the point M.

The corresponding means, which a man skilled in the art will decide upon without diverging from the scope of the claimed invention, have been shown diagrammatically in FIG. 2 by means 37 for the comparison of the instantaneous pressure $P_1$ and the pre-determined pressure $P_o$ of which it is known that it corresponds to a predetermined longitudinal tension of the web 1 and by means 38 for controlling the brake 6 according to this comparison, in order to reduce the braking if $P_1$ becomes greater than $P_o$, which results in excessive tension of the web, or on the contrary in order to increase the latter if $P_1$ becomes less than $P_o$, which results in insufficient tension.

The means 37 may advantageously be constituted by strain gauges detecting the least movement of the piston 33, i.e. the least variation of $P_1$ with respect to the value $P_o$, in order to act immediately on the brake 6 and re-establish to the pre-determined value, regulated by the regulation of $P_o$, the longitudinal tension of the web 1, the downwards action of which on the drum 14 becomes such that the pressure $P_1$ resumes a value equal to $P_o$.

Naturally the invention may have numerous variations with respect to the embodiment described and illustrated, in particular as regards the means allowing a free movement of the ends of the shaft 18 of the drum 14 by applying thereto a constant force for the purpose of tensioning the web. However, one should note the great simplicity and high efficiency of the device illustrated, when compared with the means used hitherto.

What is claimed is:

1. A device for regulating the tension of a web travelling under the action of traction, comprising spaced guide means over which said web travels and a roller which is free to rotate about its axis arranged transversely with respect to the direction of web travel, the roller being in contact with one side of the web between said guide means and deflecting the web relative to said guide means upstream of the traction means, and the device being characterized by means rotatably supporting said roller for two modes of movement in addition to rotation, namely translational movement toward and away from said guide means in a direction perpendicular to said web and tilting movement about a median transverse axis perpendicular to the axis of rotation of said roller, said supporting means comprising a support supporting the spindle of the roller at each end and allowing a movement of the corresponding end in a direction substantially perpendicular to the web, and means applying to each end, in said direction and towards the web, a predetermined force which is identical from one support to the other and is constant whatever the position of the end during its movement.

2. A device according to claim 1, comprising means for imposing a braking action of the web upstream of the roller, and the device being characterised in that it comprises means for controlling the intensity of the braking action depending on the position of the roller relative to said guide means.

3. A device according to any one of the preceding claims, in which the two supports are hydrostatic supports applying the said force by the action of a hydraulic fluid, there being a circuit provided for producing equilibrium of the pressure of the fluid in the two supports, and means being provided for keeping this pressure constant.

4. A device according to claim 2 or 3, in which the means for keeping the pressure of the fluid constant comprises means for comparing the instantaneous value of this pressure with a predetermined pressure and for controlling the braking means depending on this comparison.

5. A device according to claim 4, in which the means for comparing the instantaneous value of the pressure in the circuit for producing equilibrium with a predetermined value comprises a first chamber connected to the circuit for producing equilibrium and a second chamber connected to a source of fluid at a pressure whereof the value is equal to said predetermined value, the chambers being separated by a piston and there being means for detecting a movement of the piston towards either chamber.

6. A device according to claim 3, in which each hydrostatic support comprises a single-acting jack.

* * * * *